US006308446B1

(12) United States Patent
Healy

(10) Patent No.: US 6,308,446 B1
(45) Date of Patent: Oct. 30, 2001

(54) SIGN SYSTEM

(75) Inventor: Donall B. Healy, New York, NY (US)

(73) Assignee: Visual Graphic Systems Inc., New York, NY (US)

( * ) Notice: Subject to any disclaimer, the term of this patent is extended or adjusted under 35 U.S.C. 154(b) by 0 days.

(21) Appl. No.: 09/118,494

(22) Filed: Jul. 17, 1998

Related U.S. Application Data

(63) Continuation-in-part of application No. PCT/US96/17716, filed on Nov. 1, 1996, which is a continuation-in-part of application No. 08/590,570, filed on Jan. 26, 1996, now abandoned, which is a continuation-in-part of application No. 08/587,665, filed on Jan. 17, 1996, now abandoned.

(60) Provisional application No. 60/062,358, filed on Oct. 15, 1997.

(51) Int. Cl.[7] ..... G09F 7/04

(52) U.S. Cl. ..... 40/600; 40/611

(58) Field of Search ..... 40/600, 611, 621, 40/661.01, 711, 722, 738, 606, 120; 248/174, 469; D6/310

(56) References Cited

U.S. PATENT DOCUMENTS

| | | | | |
|---|---|---|---|---|
| 801,119 | * | 10/1905 | Van Alstyne, Jr. | 40/358 |
| 992,191 | * | 5/1911 | Hammond | 40/606 |
| 2,996,822 | | 8/1961 | Souza . | |
| 3,988,845 | | 11/1976 | Boatman . | |
| 4,017,989 | | 4/1977 | Murray . | |
| 4,023,290 | | 5/1977 | Josephson . | |
| 4,242,823 | | 1/1981 | Bruno | 40/621 |
| 4,251,936 | | 2/1981 | Ferrell | 40/600 X |
| 4,531,320 | * | 7/1985 | James | 40/621 |
| 4,907,361 | | 3/1990 | Villard | 40/565 |
| 5,167,087 | | 12/1992 | Plumly | 40/600 |
| 5,457,905 | | 10/1995 | Kaplan | 40/574 |

FOREIGN PATENT DOCUMENTS

| | | |
|---|---|---|
| 15620 | 7/1947 | (CA) . |
| 40212 | 2/1976 | (CA) . |
| 77007 | 8/1995 | (CA) . |
| 2192830 | 12/1995 | (CA) . |
| 2 032 671 A | 5/1980 | (GB) . |
| 2 249 654 A | 5/1992 | (GB) . |
| 3-168687 | 7/1991 | (JP) . |

* cited by examiner

*Primary Examiner*—Brian K. Green
(74) *Attorney, Agent, or Firm*—Darby & Darby

(57) ABSTRACT

A modular sign comprises a magnetic backing sheet, a chassis for supporting the backing sheet to provide a stable platform, and one or more sign inserts which may be coated on one side with a magnetically attractive coating so that the inserts can be held magnetically on the backing sheet. The magnetically attractive coating comprises a mixture of hydrogen reduced iron of, preferably about 325 mesh, mixed with a clear enamel printing ink in approximately equal proportions.

13 Claims, 11 Drawing Sheets

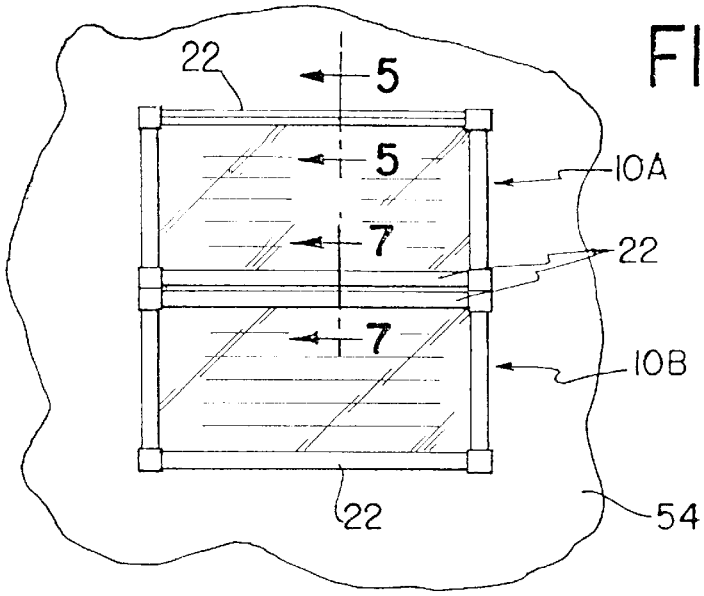
FIG. 3
FIG. 4
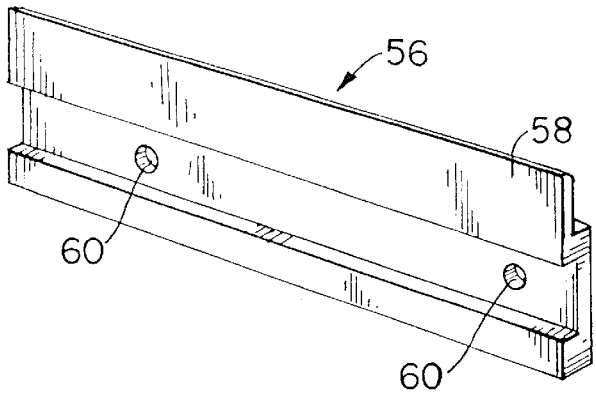
FIG. 6
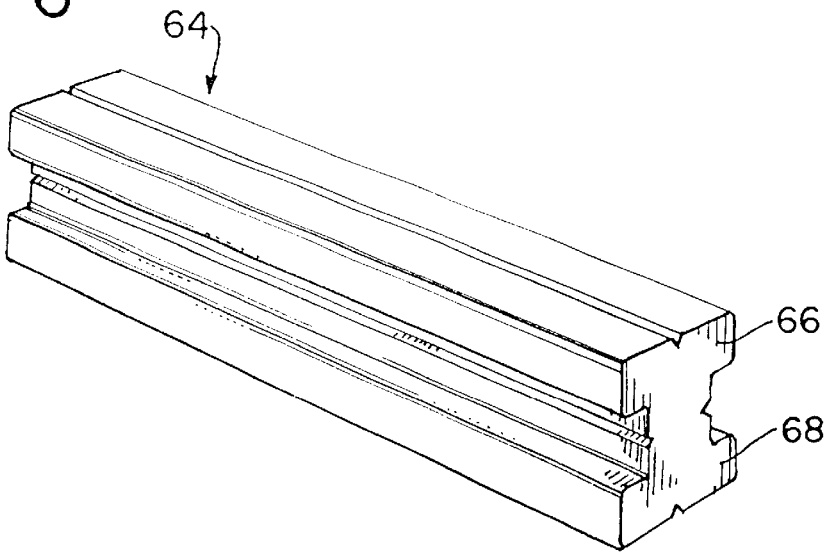

SIGN SYSTEM

REFERENCE TO RELATED APPLICATIONS

This application is a continuation-in-part of International Application No. PCT/US96/17716 filed Nov. 1, 1996, which is a continuation-in-part of U.S. Application Ser. No. 08/590,570 filed Jan. 26, 1996, now abandoned, which in turn is a continuation-in-part of Ser. No. 08/587,665 filed Jan. 17, 1996, now abandoned. This application further claims priority pursuant to 35 U.S.C. §119 based upon provisional application Ser. No. 60/062,358 filed Oct. 15, 1997. The entire disclosures of the aforesaid prior applications are hereby incorporated by reference.

FIELD OF THE INVENTION

The present invention relates to a modular sign system, i.e. a sign system which consists of one or more sign elements, any one or more of which can be easily replaced.

There are many sign systems wherein there is a need to replace parts of the sign from time to time. One representative example would be the types of signs commonly seen in cafeterias and delicatessens. Such signs may consist of promotional materials and a menu of daily specialties. The material presented on the sign is subject to change on a periodic basis and it would obviously be beneficial to replace only those portions of the sign which are to be changed, rather than the entire sign. Very often, rather than undertaking the expense of professional signage, the messages which are subject to change are simply written by hand on a blackboard or the like. Thus, there exists a need for a modular sign system in which individual parts of the sign can be easily and; inexpensively replaced without compromising the quality of the signage.

SUMMARY OF THE INVENTION

A modular sign in accordance with the invention comprises a backing sheet made of a magnetic material, a chassis for supporting the backing sheet to provide a stable platform, and one or more sign inserts mounted on the magnetic backing sheet. A light transmitting protective sheet may cover the sign insert(s). The sign insert(s) or cover sheet contain a thin coating of material which is magnetically attracted to the magnetic backing sheet so that the insert(s) are retained on the sign. In a preferred embodiment, the backing sheet is magnetic tape which includes means for aligning the sign insert(s) on the backing sheet.

In one embodiment, the magnetic backing sheet comprises magnetic tape which is attached to the chassis so as to form a frame for the sign inserts. The undersurface of the light transmitting cover sheet contains a coating of a magnetically attractive material which conforms to the magnetic tape. The magnetic attraction between the magnetic tape and the magnetically attractive material on the cover sheet retains the sign inserts in position. The protective sheet itself may function as the sign insert, for example, if the sign indicia is printed on the undersurface of the protective sheet. Alternatively, the protective sheet may be laminated to a paper, plastic or other light weight carrier which contains the sign indicia.

IN THE DRAWINGS

FIG. 3 is a front plan view showing two signs in accordance with the invention stacked vertically and secured to a wall;

FIG. 4 is a perspective view of a wall bracket which may be used to secure the sign to a wall;

FIG. 6 is a perspective view of a connector element which may be used to stack two or more signs vertically;

Figure 8:
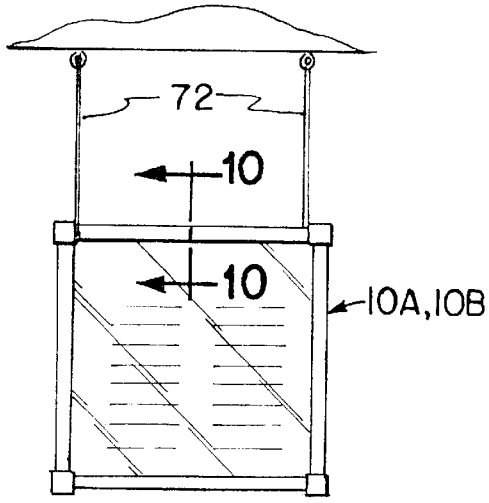
FIG. 8 is a front plan view showing two signs mounted back to back and hung from a ceiling.
Figure 9:
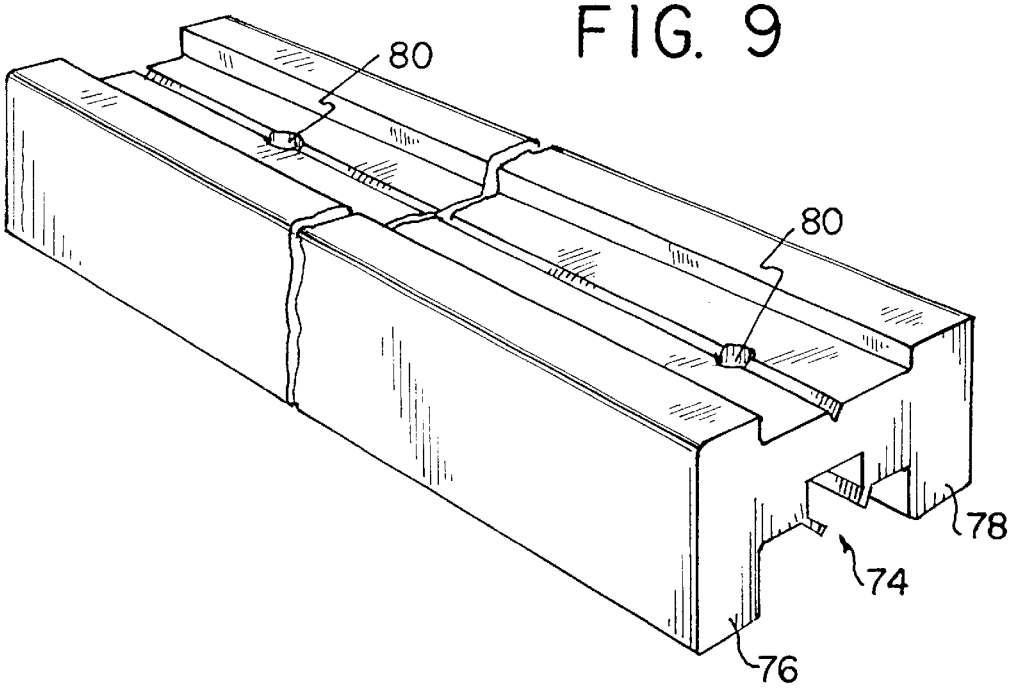
Figure 10:
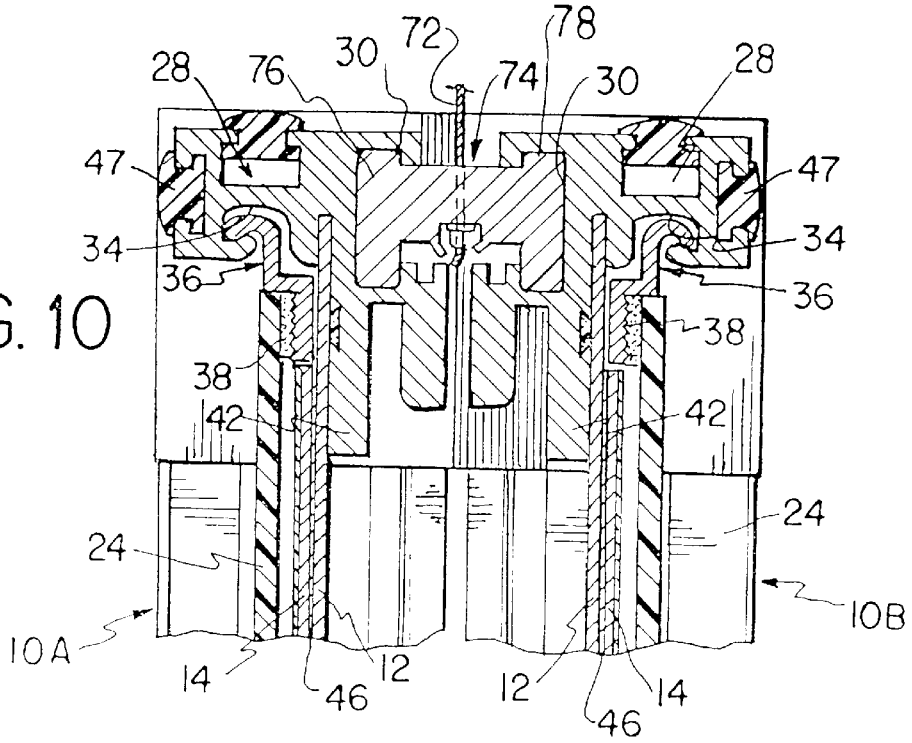
Figure 11:
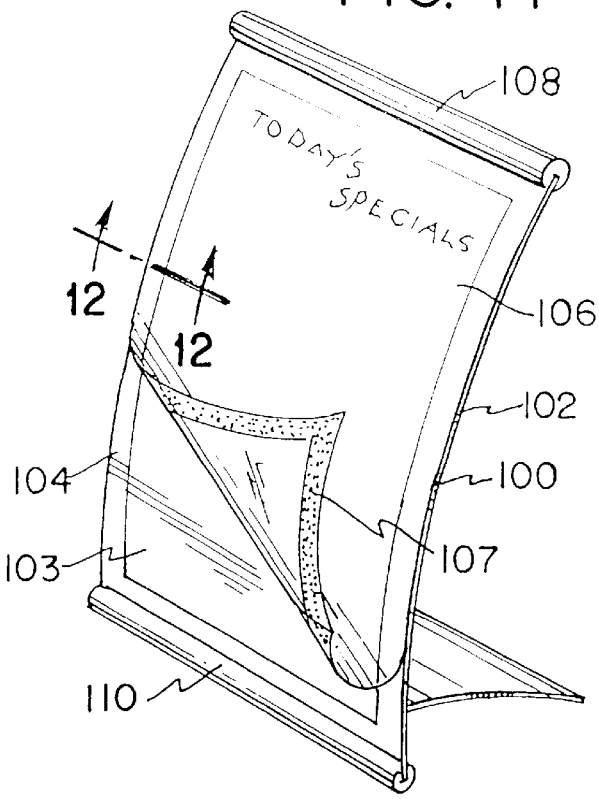
Figure 12:
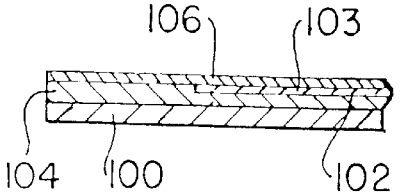
Figure 13:
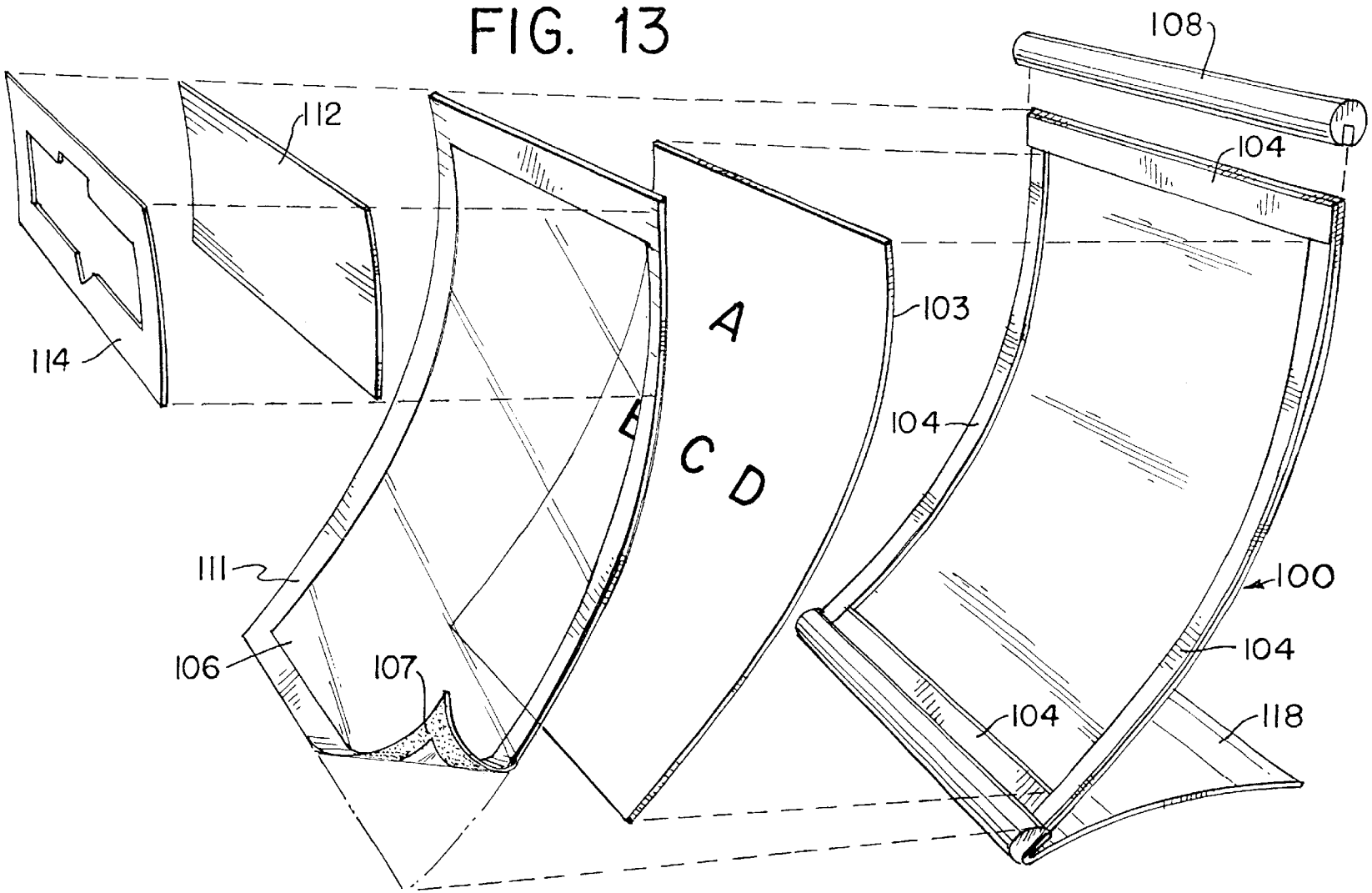
Figure 14:
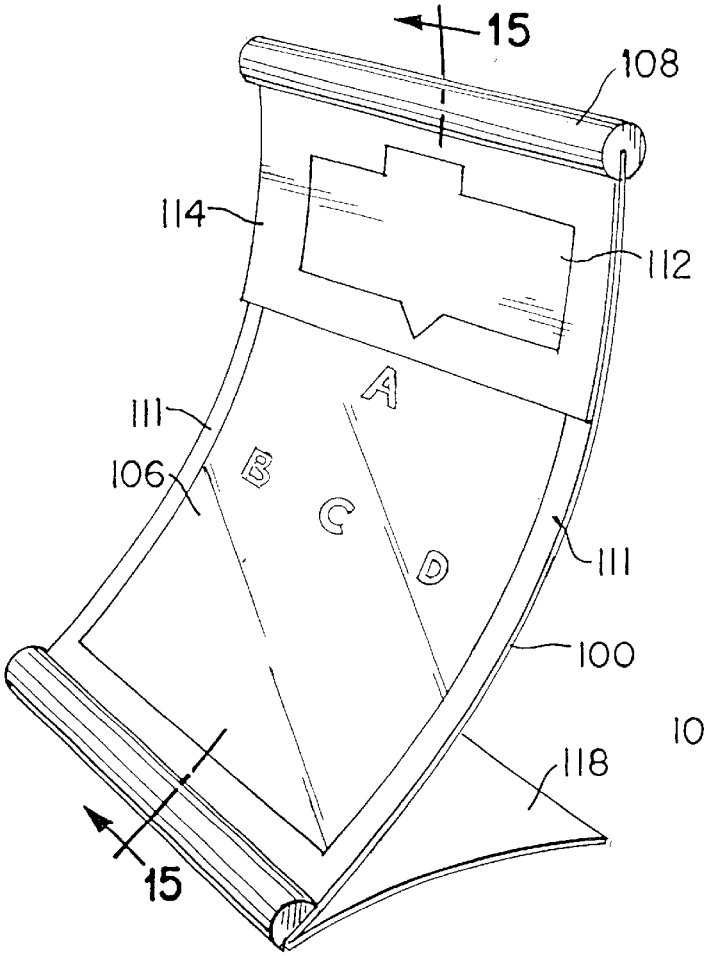
Figure 15:
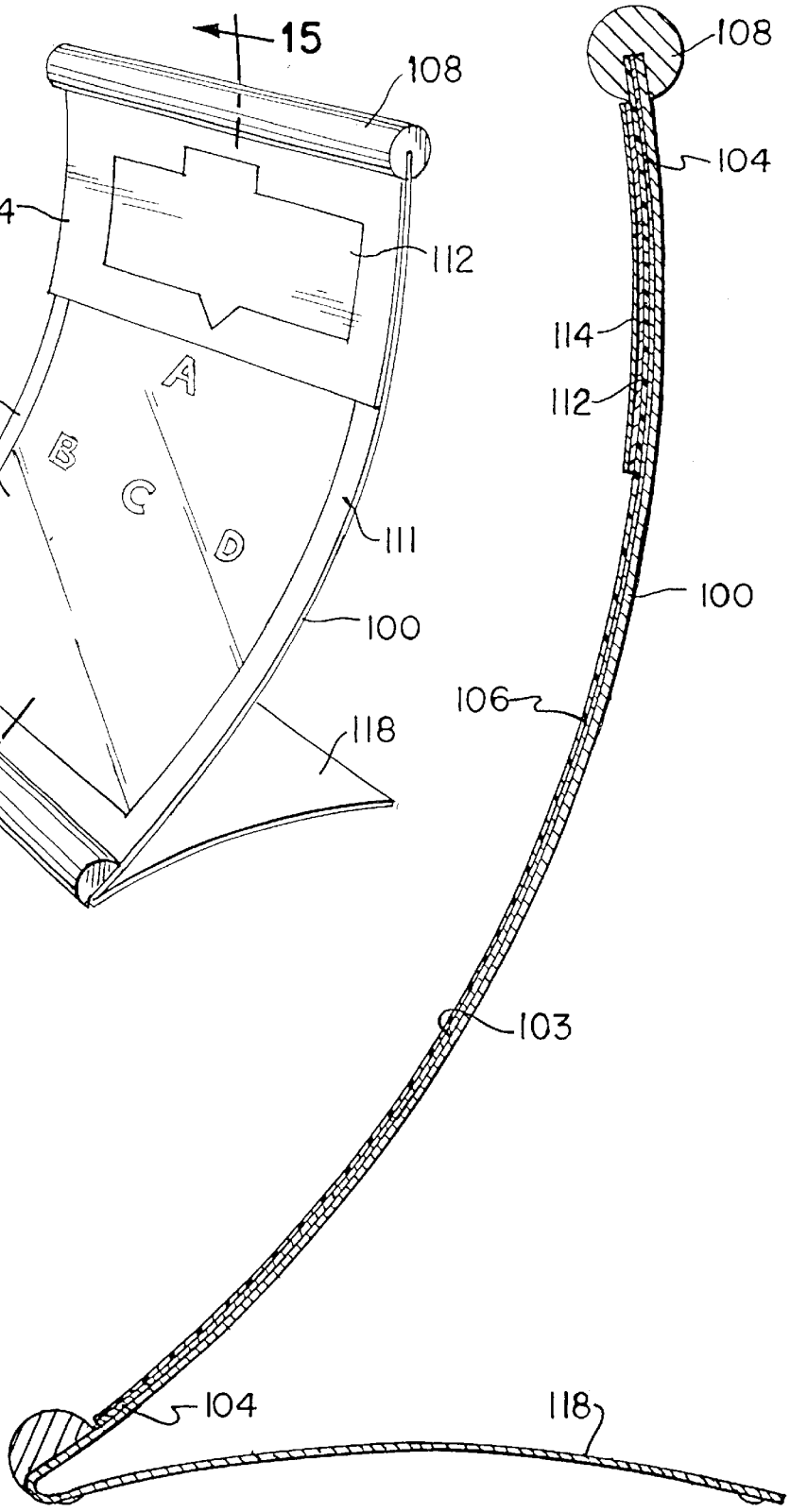
Figure 16:
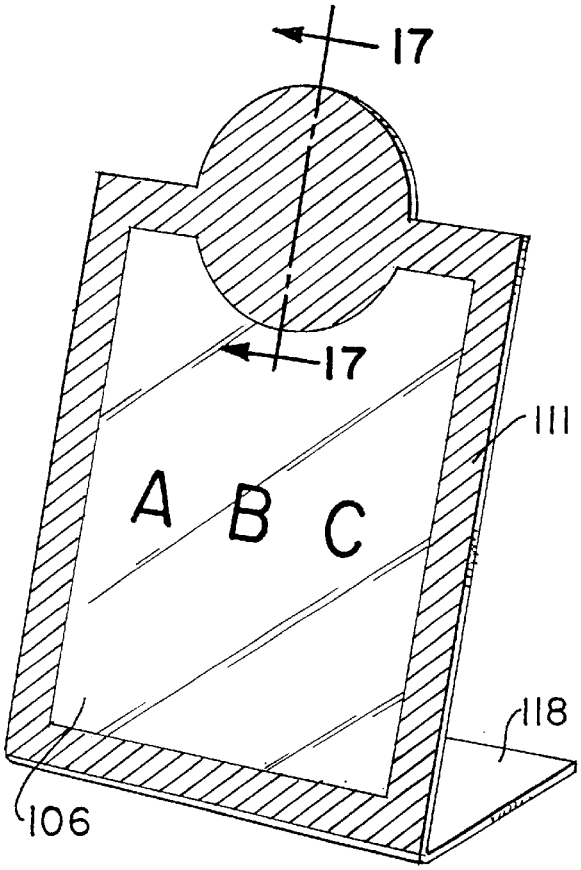
Figure 17:
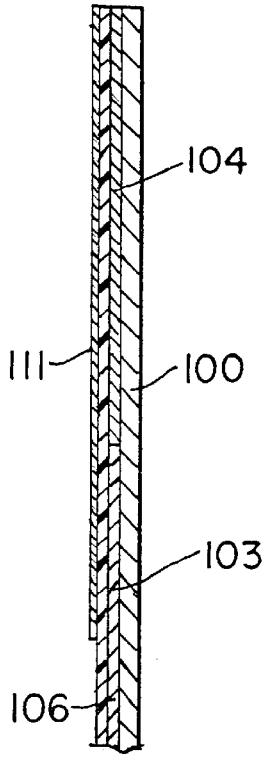
Figure 18:
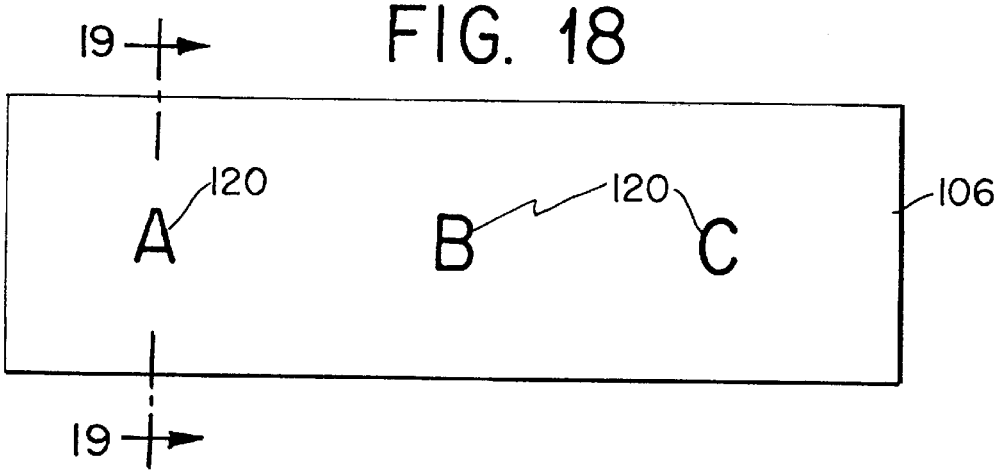
Figure 20:
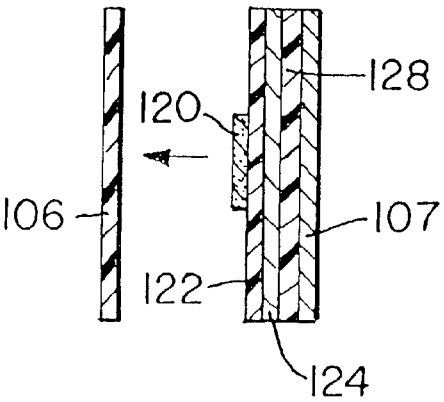
Figure 19:
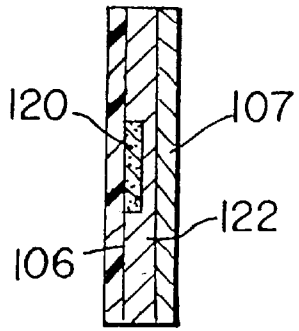
Figure 21:
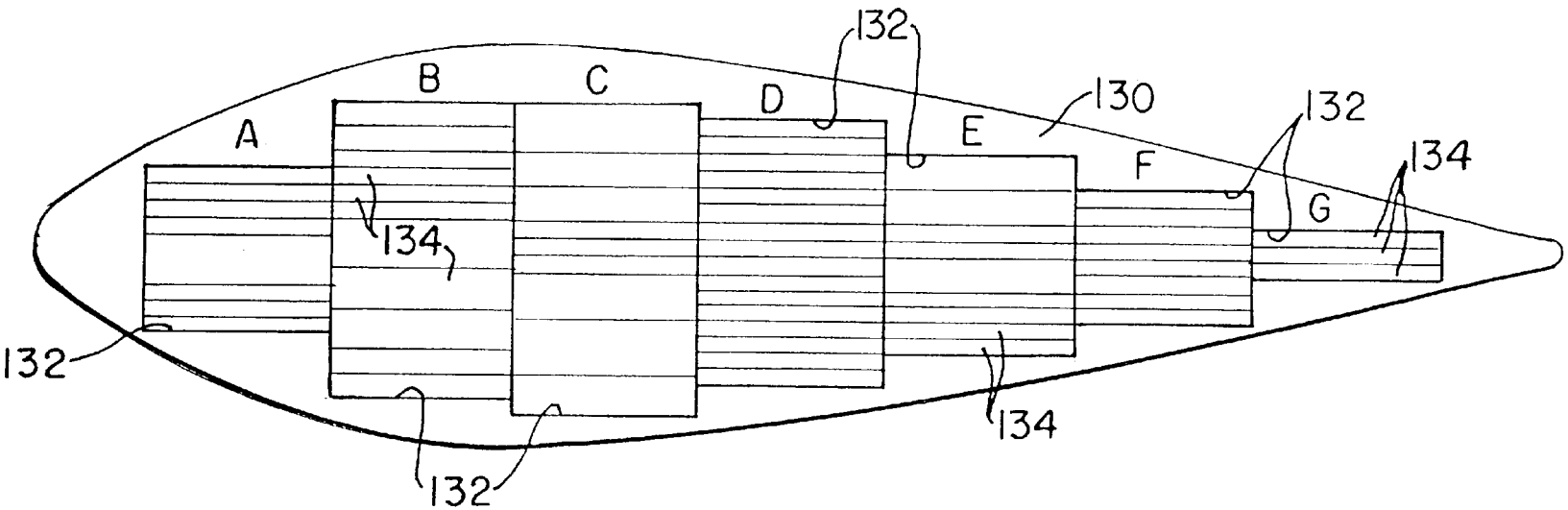
Figure 22:
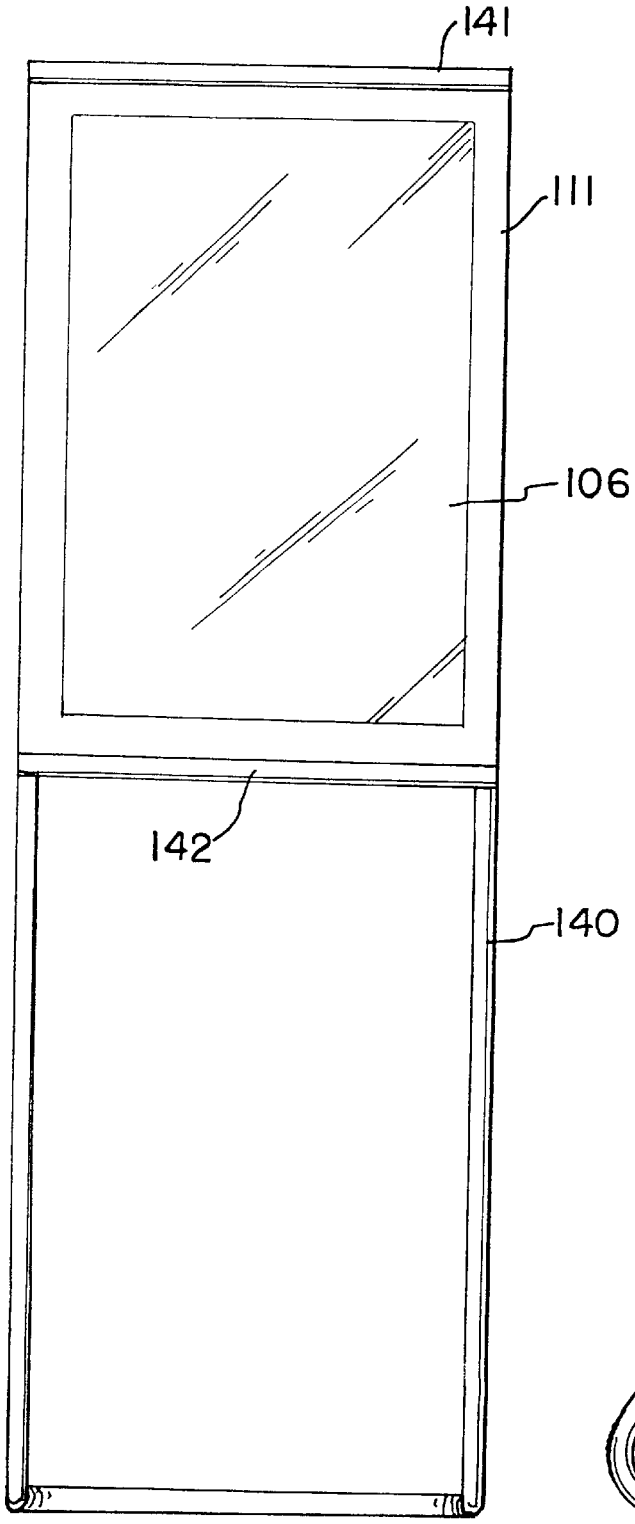
Figure 23:
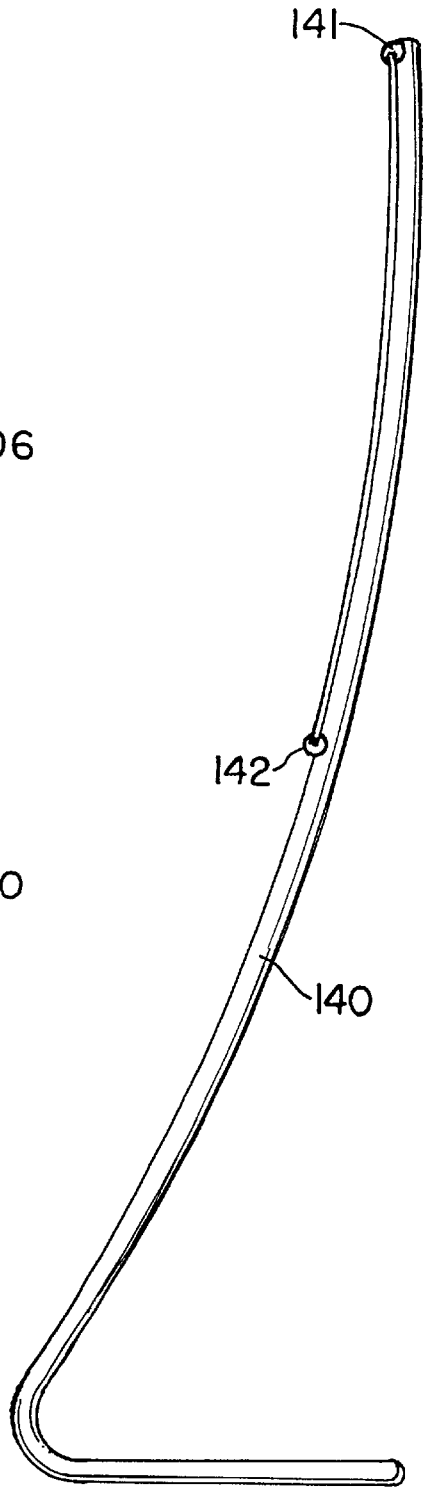
Figure 24:
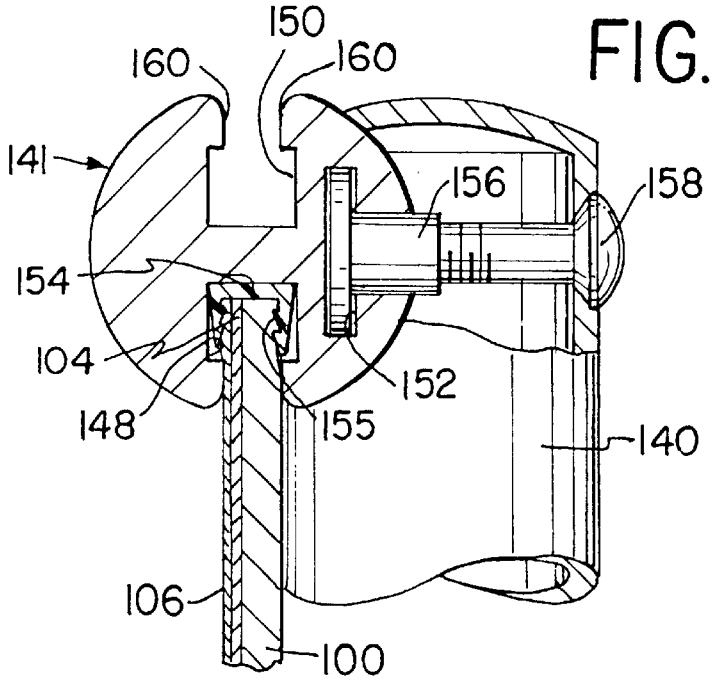
Figure 25:
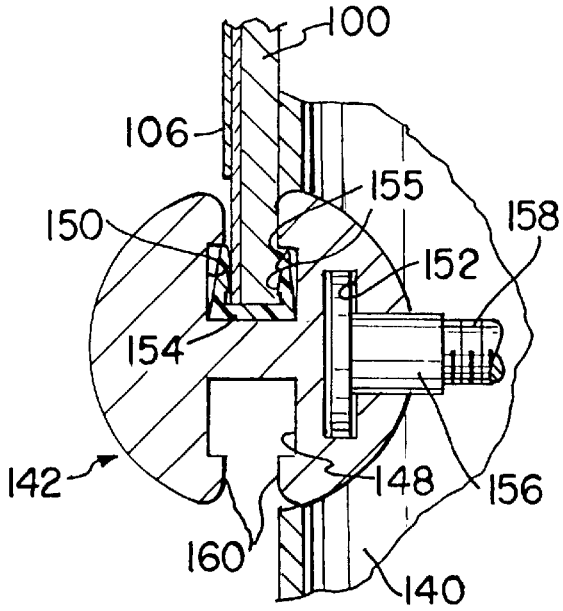

FIG. 9 a perspective view of a connector which may be used to connect two signs in a back to back relationship;

FIG. 10 is a side sectional view along the line 10—10 of FIG. 8;

FIG. 11 is a perspective view of a further embodiment of the invention in which the sign inserts are supported in a different frame;

FIG. 12 is a sectional view along the line 12—12 of FIG. 11;

FIG. 13 is an exploded perspective view of an embodiment of the invention in which the sign inserts include no magnetically attractive material;

FIG. 14 is a perspective view of the embodiment shown in an exploded view in FIG. 13;

FIG. 15 is a side sectional view along the line 15—15 of FIG. 14;

FIG. 16 is a perspective view of a further embodiment of the invention in which the header is integrally formed with the protective cover;

FIG. 17 is a side sectional view of the sign shown in FIG. 16;

FIG. 18 is a top plan view of a sign insert in which the sign indicia are printed directly on the protective cover;

FIG. 19 is a side sectional view along the line 19—19 of FIG. 18;

FIG. 20 is a partially exploded side sectional view of a sign insert in accordance with a still further embodiment of the invention;

FIG. 21 is a front plan view of a sign made in accordance with the invention in which the chassis assists in registering the sign inserts;

FIG. 22 is a front plan view showing the invention used to support a relatively large poster on a stanchion;

FIG. 23 is a side sectional view of the embodiment shown in FIG. 22;

FIG. 24 is a side sectional view showing the construction of an extrusion used in the embodiment of FIG. 22; and FIG. 25 is a side sectional view showing the construction of the lower extrusion illustrated in FIGS. 22 and 23.

DETAILED DESCRIPTION

Figure 1:
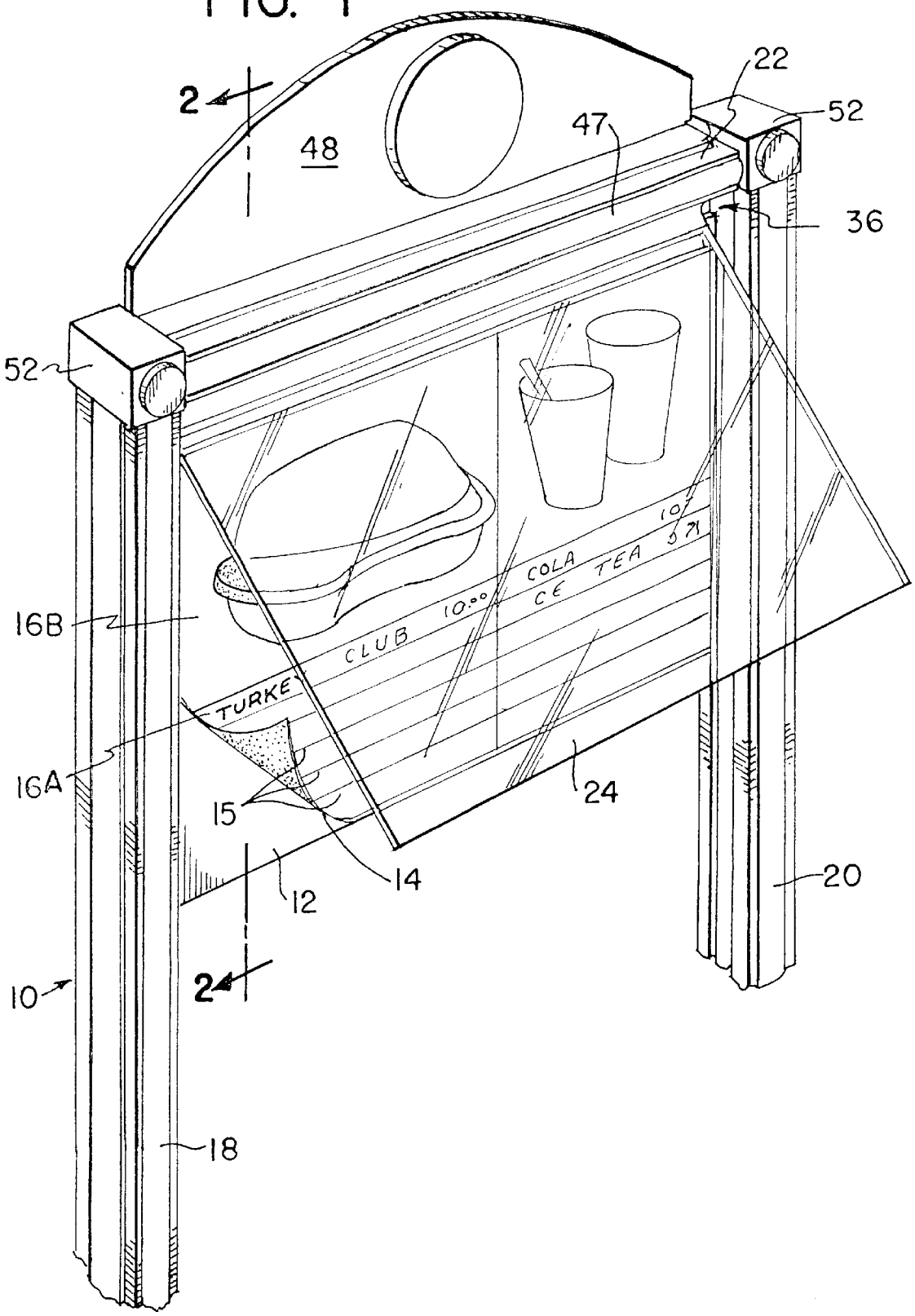
FIG. 1 is a perspective view of a modular sign system in accordance with a preferred embodiment of the invention.

The basic components of a first embodiment of the invention are shown in FIG. 1 which represents a free standing sign comprising a frame 10, a steel chassis 12, a magnetic sheet 14 containing alignment ribs 15, and a multiplicity of sign inserts 16. The sign inserts may be in the form of strips 16A or larger inserts 16B. Obviously, the shape of the sign inserts and their number form no part of the invention. In the free standing embodiment of FIGS. 1 and 2, frame 10 comprises two vertical legs 18 and 20 and an upper horizontal member 22 supported on top of the legs 18 and 20. The components of frame 10 may be secured in any suitable fashion.

The sign itself may be covered by a transparent cover 24, for example made of acrylic, which is supported in a support hinge 26.

A principal feature of the invention is the use of the flexible, magnetic sheet 14 as a means for retaining and supporting the individual sign inserts 16A, 16B.

In a preferred embodiment, the sheet 14 comprises a commercially available magnetic tape sold by Flexmag under the trademark ULTRAMAG. This material, for example, may be about 0.02 inches thick and can easily be embossed with the alignment ribs 15 without affecting the magnetism of the sheet. For example, the alignment ribs 15 may be formed by conventional hydroforming processes. Hydroforming is an inexpensive way of forming ribs 15 to enable the magnetic backing sheet 14 to accept inserts of any configuration. In addition to rectangular inserts, circular, triangular and other unusual shapes can be defined in the backing sheet 14 by the molded alignment ribs 15. Heat forming (taking care that the heat does not destroy the magnetism) and cold die stamping may also be used to emboss the backing sheet.

The sign inserts 16 are "disposable" and, preferably, made of or include a material which is magnetically attracted to the magnetic sheet 14. These inserts may comprise a thin sheet or veneer, for example paper, plastic, wood, formica, aluminum, etc. having an inexpensive magnetically attractive coating on the side facing the magnetic sheet 14. As used herein, the term "magnetically attractive coating" is intended to include any substance which can be coated or spread onto a supporting surface, e.g. paper or film, and which is magnetically attracted to a magnetic surface. By way of example, the magnetically attractive coating may be a mixture of iron powder and printing ink. The quantity of iron powder and the thickness of the coating can be adjusted to control the magnetic attraction between the backing sheet and the sign inserts.

Iron powder is produced by four different processes, namely, atomization, carbon monoxide reduction, hydrogen reductions, and an electrolytic process. It has been discovered that hydrogen reduced iron powder is particularly useful in manufacturing a magnetically attractive coating for use with the invention. This is believed to be due to the fact that hydrogen reduced iron powder is "fluffier" than other powders i.e. is less dense, having greater surface porosity and, therefore, greater surface area. These characteristics enhance the ability of the powder to absorb ink which protects the particles from air and consequent oxidation.

As a commodity, iron powder is available in various sizes from 20 to 150 mesh and them jumps to 325 mesh, approximately 45 microns. Typical uses of the coarser powders are in the manufacture of sintered parts; finer powders are used in plating mirrors and as food additives. For purposes of the invention, experiments conducted with a mixture of 150 mesh iron powder and standard inks resulted in a coating so coarse that the magnetic attraction between a typical sign insert and the magnetic tape was inadequate. This is believed due to the fact that the contact between the coating and magnetic tape was insufficiently intimate. Satisfactory contact is obtained, however, with 325 mesh iron powder.

It has also been discovered that iron powder, when mixed with many types of inks to form a magnetically attractive coating, tends to settle with time. This is undesirable because the coating should contain an evenly dispersed concentration of iron particles at the time it is applied to a surface. If the particles tend to settle, the mixture must be mixed at or just prior to the time of application. If settling is too rapid, even during a given run the nature of the coating may change from beginning to end.

It has been discovered that when 325 mesh hydrogen reduced iron powder is mixed with an enamel ink in a ratio of approximately 50/50 by weight, the resultant mixture remains "homogenized" and provides a thick, uniform coating when applied through a coarse screen. By way of example, a clear, oil based "gloss enamel" such as Naz Dar's 5900 Series ink has been found to produce excellent results. Preferably, the particles and ink are mixed by means of an electric paint mixer. Even after several days, a gallon of enamel based coating of this type settles so little that it requires only hand stirring to be usable. In contract, a magnetically attractive coating formed with conventional lacquer based inks tends to separate overnight, thus requiring mixing by means of an electric mixer if the product is to be used.

The optimum method of applying the magnetically attractive coating to a surface is by means of screen printing. A 60 mesh, monofilament polyester screen has proven to be effective, providing a thick coating while controlling image quality. Image quality is not a major consideration when coating an entire surface but does come into play when printing orders or producing shaped surfaces for any of the sign inserts.

With respect to the enamel, a clear enamel is preferred because, in a pigmented ink, the pigment takes the place of the ferrous particles and reduces the magnetic attraction.

The sign indicia can be printed electronically on the insert 16 using laser or inkjet printers, or electrostatic copiers. Other conventional printing processes may also be used. A large substrate may be precut to conform to the desired sign insert specifications so that the inserts can be separated after printing. Since they can be printed quickly and on short notice, even perhaps at the user's facility, despite their low cost and interchangeability, the inserts nevertheless give the impression of professionally produced signage. After printing the inserts may be laminated with a transparent film to protect the image and background.

The transparent cover 24 in FIG. 1 can be made of acrylic. The cover provides protection from the environment and scratch resistance. If a matte acrylic is used, glare is eliminated and the appearance enhanced. The cover may extend over the entire sign or any portion thereof. Two or more covers may be provided if desired. In FIG. 1, the cover is physically mounted in the upper frame member 20 but it may also be supported in either of the vertical members or in a bottom frame member (as shown in FIG. 1).

In its broadest terms, the invention contemplates every possible device for physically supporting the magnetic sheet (s) so that the individual sign inserts can be easily changed. The arrangements shown in FIGS. 1–11 are particularly beneficial in this respect.

In these embodiments, each of the frame members 18, 20 and 22 are extruded for example, from aluminum. They may each be identical having the cross sectional shape shown in FIG. 2 although as will become apparent from the following description, the vertical legs 18 and 20 do not necessarily require the same connector channels as now described.

The extruded frame member 22 includes four principal channels. These are a stacking connector channel 28, a back-to-back connector channel 30, a wall support connector channel 32, and a cover support channel 34. Since the embodiment of FIGS. 1 and 2 is free standing, the connector channels 28, 30 and 32 are not used for a connecting function and their functions are described further below with reference to FIGS. 6–10.

The transparent cover 24 is secured to a hook shaped cover support hinge 36 by means of an adhesive 38. The hook shaped portion of the hinge 36 is retained within the cover support channel 34 as shown in FIG. 2, the arrangement being such that the transparent cover can be pivoted upwardly to enable replacement of the sign inserts 16A, B. The relationship between the hinge 36 and support channel 34 also is such that the cover can be removed entirely from the channel if desired.

The steel chassis 12 is attached to the frame members 18, 20 and 22. The way in which it is attached to each frame member is the same and is illustrated in FIG. 2 with respect to frame member 22. A chassis support slot 40 formed in the underside of the frame member 22 receives the upper portion of the steel chassis 12 which is secured to a downwardly depending ledge 42 by means of an adhesive 40*a*. Analogous support slots in frame members 18 and 20 securely retain the steel chassis within the frame. The molded magnetic sheet 14 may be attached to the chassis 12 by means of an adhesive layer 46. Adhesive 46 may not be necessary if "doublesided" magnetic tape is used wherein the force of attraction between the magnetic sheet 14 and steel chassis 12 will be sufficient to retain the magnetic sheet in position to receive the insert 16. This would allow for quick and inexpensive retrofitting when required.

Figure 2:
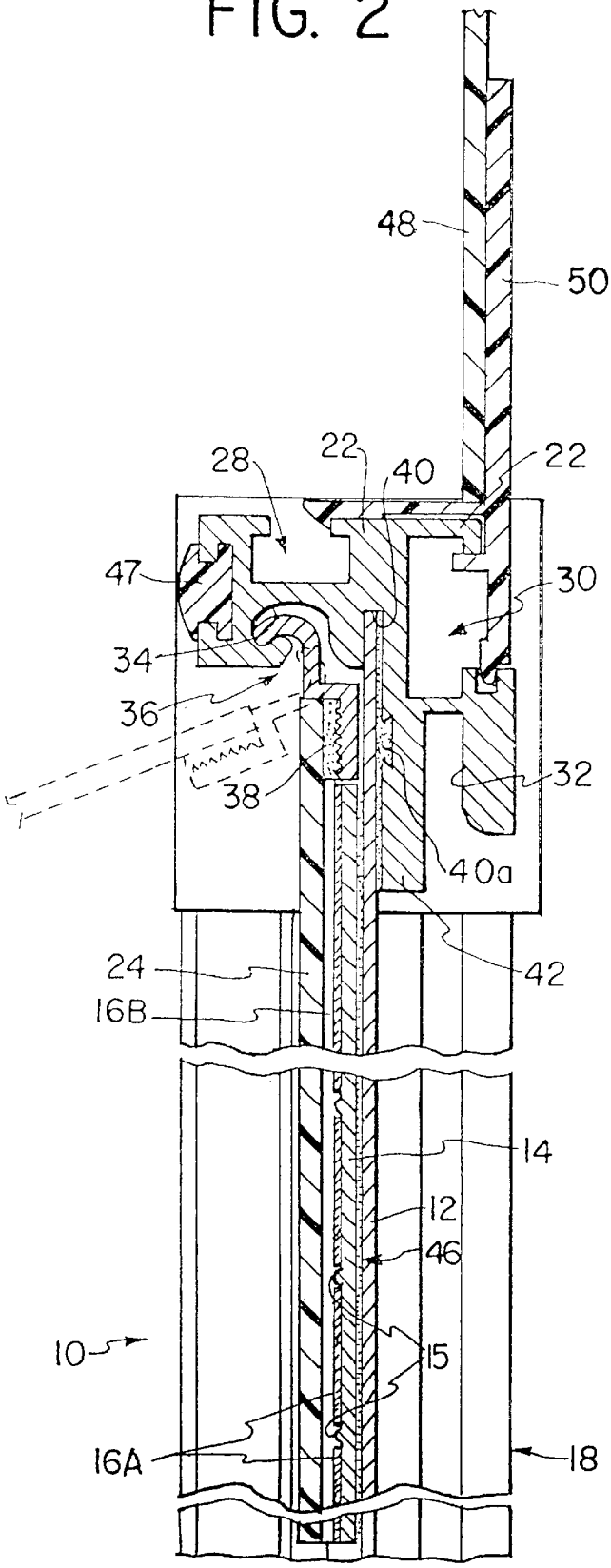
FIG. 2 is a side sectional view along the line 2—2 of FIG. 1.
Figure 5:
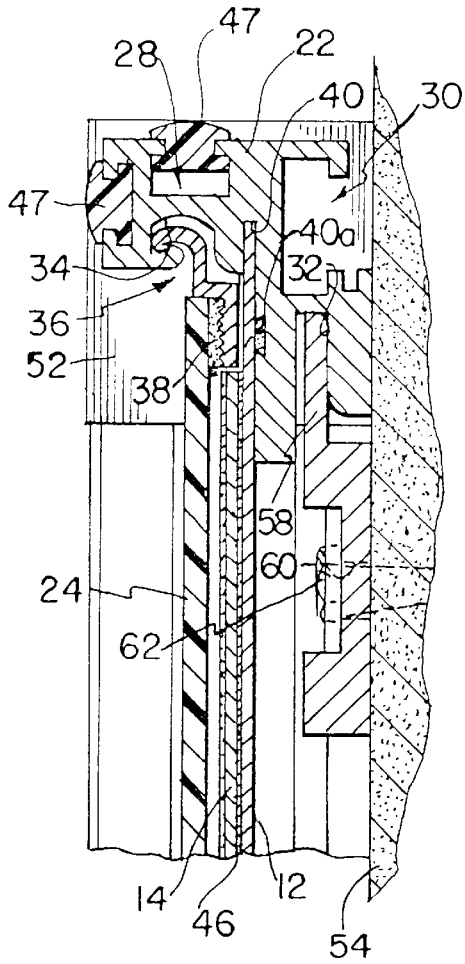
FIG. 5 is a side sectional view along the lines 5—5 of FIG. 3.
Figure 7:
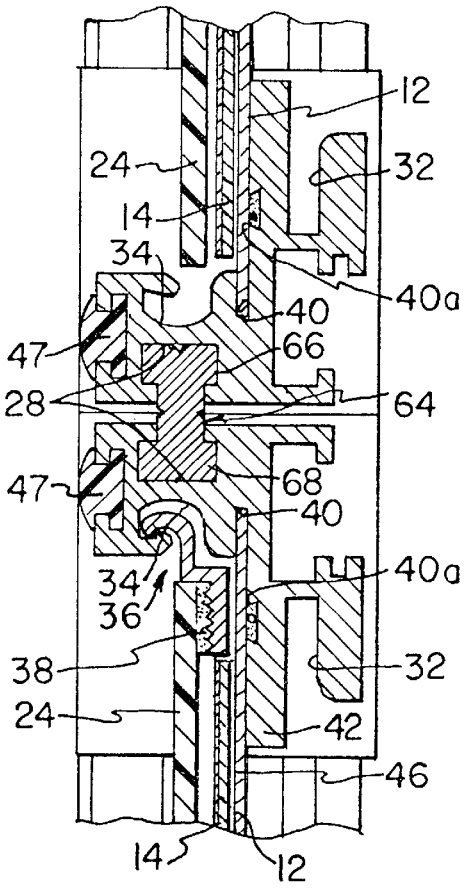
FIG. 7 is a side sectional view along the lines 7—7 of FIG. 3.

In the free standing sign of FIGS. 1 and 2, a decorative strip 47 and decorative trim 48 are mounted at the top of the sign. These decorative elements are for aesthetic purposes and form no part of the present invention. The strip 47 may slide into an appropriate channel (not numbered) within the forward face of the frame member 22. A trim support member 50 shaped as shown in FIG. 2 supports the decorative trim 48 and is retained within the channels 28 and 30 as shown to provide a stable platform for the trim 48.

Also, for aesthetic purposes, a corner piece 52 may be provided at each corner of the frame 10 to cover the junctions of the frame members. As indicated above, the frame members may be joined in any desired fashion. The ends may be mitered, and L-shaped brackets or the like used to hold adjacent frame members together, the bracket legs being received within abutting channels 28 and 30.

FIG. 3 shows two four sided frames 10A and 10B vertically stacked and mounted on a vertical wall 54. The individual frames 10A and 10B may be the same as shown in FIGS. 1 and 2 but since they are not free standing, upper and lower horizontal frame members 22 are required.

FIG. 4 shows in perspective form a mounting bracket 56 which includes a vertical extension 58. Mounting holes 60 are provided in a recessed section (not numbered) so that the wall bracket 56 can be attached to the wall 54 by fasteners 62 such as screws, bolts or the like. The vertical extension 58 of bracket 56 fits tightly into the wall support connector channel 32 within frame member 22. Thus, after bracket 56 has been fastened to wall 54, the sign can be mounted by simply lifting it over the top of the extension 58 and permitting the frame to drop to the position shown in FIG. 5.

FIG. 6 shows a connector 64 which may be used to vertically stack the frames 10A and 10B. Connector 64 is also an extrusion and includes upper and lower sections 66 and 68, respectively, which have shapes complementary to the connector channel 28. Accordingly, if the upper section 66 of the connector 64 is slid into the connector channel 28 of an upper frame and the lower section 68 of the connector slid into the upper connector channel 28 of an adjacent frame, a pair of frames can be vertically stacked with the connector 64 providing a secure and stable means for securing the two together (see FIG. 7). The same principles can be used to join and align two or more signs horizontally.

FIGS. 8 and 9 illustrate two additional arrangements in accordance with the invention wherein two frames are mounted in back to back fashion and hung from a ceiling by means of cables 72, two of which are shown in FIG. 8. The back to back connector, which also may be an extrusion, is shown in FIG. 9. In this case, the connector includes left and right sections 76 and 78 which are shaped to mate with the back to back connector channel 30 as shown in FIG. 10. Mounting holes 80 are provided in the center of the connector 74 so that cable 72 can be attached to the connector in any desired fashion.

A wide variety of different types of sign inserts can be used with the invention. As one example, a laser printed paper insert may have the magnetically attractive coating screen printed on its back surface. A protective gloss or matte laminate may be applied to the front surface of the sign insert before or after the coating is applied.

Also contemplated is a laminated sign in which the magnetically attractive coating is applied to a clear laminating film. The printed sign (on paper or any other medium) can then be sandwiched between the ferrous coated laminating film and a top layer of laminating film to provide a durable, laminated sign insert.

In a further embodiment, the magnetically attractive backing is printed directly onto an adhesive film, for example, Scothcal™ ElectroCut™ vinyl film (sold by 3M Company). The thus coated self-adhesive film, after removal of its protective coating, can be applied to the back of photographs, menu listings, or any other sign insert for magnetic application to the magnetic sheet. The magnetically attractive coating could also be printed on self-adhesive paper, such as die-cut labels, letter forms, or promotional "snipes" for the same purpose.

To protect the magnetically attractive coating, a light clear protective coating (e.g., a clear screen printing ink or lacquer spray) may be applied to the coating. This will provide a seal for the coating mixture which may be somewhat "chalky". It will also inhibit rusting which can occur if a ferrous coating is exposed to water.

In accordance with the basic invention, the magnetic sheet may be supported in any of a variety of different ways other than as illustrated in FIGS. 1–10. As one example only, FIGS. 11 and 12 show a chassis 100 configured as shown so that it can rest on a horizontal surface with a curved, slightly inclined supporting surface. A magnetic backing sheet 102, which may be identical to the magnetic backing sheet 14 of FIGS. 1–10, is supported on the curved surface of the chassis 100. The magnetic backing sheet may be held in place by means of an adhesive or the magnetic backing sheet may be made of double sided magnetic tape in which case it can be magnetically adhered to the chassis 100 if the chassis is made of a ferrous material. In FIGS. 11 and 12, a single sign insert 103 is magnetically retained on the backing sheet 102. The magnetic backing sheet may be embossed to include a raised magnetic border 104 which retains the sign insert 103. The sign is covered by a flexible, transparent sheet 106 having a ferrous coating 107 along its edges. The ferrous edge coating 107 is non-magnetic, i.e., it is not a magnet, but it is magnetically attracted to the magnetic border 104 to retain the transparent sheet and provide a seal as well as a vandal resistant "lock". With this arrangement it is possible to retain a paper or plastic sign insert. This arrangement is particularly useful with curved signs since it enables the cover sheet to conform to the shape of the sign. The same arrangement may be used to retain the cover 24 in the embodiments of FIGS. 1–9.

FIGS. 13–15 show an embodiment of the invention similar to the embodiment of FIGS. 11 and 12, used to retain a paper or plastic sign insert which contains no magnetically attractive material. The same numbers are used in describing the elements of this embodiment as were used to identify the corresponding elements shown in FIGS. 11 and 12.

In the embodiment of FIGS. 13–15, the sign is concave and the magnetic tape, instead of covering the entire exposed surface of chassis 100, forms a raised border 104 around the periphery of the chassis. The sign insert 103 does not include a magnetically attractive coating on its back but is cut to fit within the raised border 104 formed by the magnetic tape with its entire back surface engaging the chassis within raised border 104. The undersurface of the transparent cover 106 contains a ferrous coating 107 on its edges which conforms to the magnetic tape whereby the attraction between the ferrous coating and the raised border 104 retains the sign insert 103 within the raised border 104, between the rear surface of cover 106 and chassis 100. The upper edge of the cover sheet 106 is adhesively retained or pressure fit within a slot (not numbered) in upper trim cap 108. A border 111 is printed on the upper surface of the cover 106 to hide the ferrous coating 107.

As shown in FIG. 15, when cover sheet 106 is in place, its undersurface engages the outer surface of sign insert 103.

The protective cover 106 may be made of many different light transmitting materials. A preferred material is Lexan® polycarbonate sheet, the thickness of which may be selected depending on the size of the sign.

If it is desired to provide a replaceable header, a second magnetic tape 112 may be adhesively attached to the upper surface of transparent cover 106 at the top of the sign. The header 114 is similar to the sign inserts previously described and includes a magnetically attractive coating on its rear surface which is attracted to the magnetic tape 112.

The chassis 100 includes the curved face on which the magnetic tape is mounted and an integral base 118 which supports the sign. As illustrated, the entire area of the chassis which supports the sign insert is curved, causing the sign insert to assume the same curve. In the preferred embodiment of the invention, the base has the same radius as the sign face which permits the entire chassis 100 to be rolled in a single piece. The base 118 is then formed by brake-forming with a single bend.

Another embodiment of the invention is shown in FIGS. 16 and 17. In this embodiment, the chassis is flat and the header is printed directly on the exposed surface of the transparent cover sheet. As shown in FIG. 17, the magnetic tape forming the raised border 104 conforms in shape to the outer periphery of the sign, including the upper portion of the header. Again, the magnetic tape provides a raised border for the sign insert which is not magnetically attracted to the chassis. The shaded portions of FIG. 16 represent the printed material. Printing in this case can be done, for example, by ink jet or screen printing.

FIGS. 18 and 19 illustrate a sign insert in which the sign is printed directly on the transparent cover 106. The sign indicia, shown at 120, are printed in reverse on the back of the sheet 106. The background 122 is then printed and the magnetically attractive coating 107 applied to the background 122. Any suitable printing process, including screen printing, roller coating or spraying may be used to apply the indicia 120 and background 122.

If a screen printing or lithographic process is used, a large transparent cover sheet 106 may be printed with a multiplicity of different sign inserts at a single time. The individual sign inserts may be separated by "kiss cut" die cuts. This would enable the user to easily separate the individual sign inserts at the time of use.

FIG. 20 shows another structure similar to the sign shown in FIGS. 18 and 19. In this case, the sign background 122 and indicia 120 are printed in customary fashion on a paper or plastic carrier 124. The back of the carrier 124 may be coated with vinyl 128 to which, in turn, is applied the magnetically attractive coating 107. This element is then laminated to the transparent cover sheet 106, for example, adhesively. The purpose of the vinyl 128 is to isolate the carrier 124 and ferrous coating 107 and the vinyl may not be required in all cases.

Still a further embodiment of the invention is shown in FIG. 21. In FIG. 21, the chassis 130, shown in the form of a surfboard, includes a shaped periphery forming a series of recessed areas 132 for receiving different sign inserts 134. The magnetic tape, in this case, is placed in each of the recessed sections which function to automatically align the various sign inserts. A cover sheet is not used and the sign inserts are therefore coated with the magnetically attractive material. A transparent laminate or coating may be applied to the exposed surface if needed.

In the illustrated embodiments, the chassis may be made of plastic, metal or other material. When the chassis is concave, it is well suited to a lighted sign with the light mounted within the upper or lower trim caps, in which case the light tends to fall more directly on the contents of the sign. The chassis may be also be made of a transparent material (for example acrylic) in which case it can be lit from the back. If the chassis is curved, the curve will be beneficial in that it will tend to even the illumination on the face of the sign and avoid "hot spots".

Many different embodiments of the invention are contemplated. The invention may be in the form of a self-supporting sign or it may be in the form of a sign which is mounted on a wall or hung from a ceiling. Size, of course, is not material and indeed the principles of the invention are particularly adapted to large posters which, for example, may be mounted on individual stands.

Such a version of the invention is shown in FIGS. 22–25 which shows a self-supporting curved stanchion 140 intended to rest on a floor. The sign is supported between upper and lower bars 141 and 142, respectively. The basic sign construction may be that which is shown in FIGS. 13–15, i.e. with the magnetic tape forming a raised border for the sign insert 103, the sign insert being retained in the frame by the flexible, light transmitting protective cover 106 (see FIGS. 23 and 24).

The arrangement shown in FIGS. 22–25 permits the poster holder to be divided horizontally into two or more sections with independent light transmitting protective covers. The plastic or metal chassis may be made of a flexible material which is forced to conform to a curved configuration by wedging it between the upper and lower horizontal bars 141 and 142.

FIGS. 24 and 25 show a construction of the upper and lower bars 141 and 142, respectively, which has particular utility in mounting relatively large signs such as posters.

Each of the bars may be a metal extrusion (for example, aluminum) including lower and upper channels 148 and 150, respectively, and a side T-shaped channel 152. In the illustrated embodiment, the sign is supported within the lower channel 148 of upper extrusion 141 and the top channel 150 of the lower extrusion 142. For this purpose, elongated, resilient plastic clips 154 U-shaped in cross section are provided.

The clips 154 may be extruded from a suitable plastic material, such as stryrne. Their purpose is to hold the protective sheet 106 against the chassis 100. Each clip includes "one-way" teeth 155 which grip the cover to minimize the likelihood of accidental removal when the cover is lifted to change sign inserts. However, if it is necessary for the cover to be changed, the clip should have enough "give" so that the cover can be pulled from the clip with mild force. The open end of the u-shaped clip has rounded edges to facilitate insertion of the cover and chassis into the clip.

The T-shaped groove 152 in the extrusion is designed to accept a common tee-nut 156, two of which are positioned in the groove and used to connect each horizontal extrusion 141 and 142 to the stanchion 140 by means of counter-sunk machine screws 158. The channel 150 which receives clip 154 includes small projections 160 which serve to hold the clip 154 in place. The bottom edges of these projections also are rounded to facilitate insertion of the clip 154 into channel 150. The protective sheet and chassis may be inserted into the clip before or after the clip is placed in the channel.

In the preferred embodiment, the bars 141, 142 are extruded from aluminum. The invention also contemplates routing or milling any material such as wood, acrylic or brass, etc. of any shape, i.e. round, square, beveled, etc. By combining the inexpensive extruded clip with different trim caps, a large variety of decorative options are available at low cost.

What is claimed is:

1. A sign for use with one or more replaceable sign inserts, comprising a chassis adapted to be supported in an upright position, a raised border of magnetic material attached to said chassis, at least one replaceable sign insert within said raised border of magnetic material, said sign insert having front and back surfaces with the entire back surface contacting said chassis, and a flexible, light transmitting cover sheet covering said sign insert, said cover sheet having an outer surface and an undersurface which engages the sign insert, and including a magnetically attractive material which is not a magnet coated on its undersurface adapted to hold the flexible, light transmitting cover sheet against said raised border of magnetic material.

2. A sign according claim 1, wherein said flexible, light transmitting cover sheet further includes a printed border obscuring said magnetically attractive coating.

3. A sign according to claim 2, wherein said printed border is on the outer surface of said cover sheet.

4. A sign according to claim 2, wherein said printed border is on the undersurface of said cover sheet and said magnetically attractive coating is applied to said printed border.

5. A sign according to claim 1, wherein said cover sheet is mechanically attached to the chassis along one edge.

6. A sign according to claim 1, wherein said magnetically attractive coating comprises a mixture of iron powder and printing ink.

7. A sign according to claim 1, further comprising an extrusion for holding said chassis, raised border and cover sheet together at one edge, said extrusion including at least one channel and a resilient, U-shaped clip within said channel, said one edge of the chassis, raised border and cover sheet being retained within said clip.

8. A sign according to claim 7, wherein said extrusion includes a second channel, and means positioned in said second channel for mounting said sign on a support means.

9. A sign according to claim 1, wherein an entire area of the chassis contacting the back surface of the sign insert is concave.

10. A sign according to claim 9, wherein the chassis includes a concave upright surface and a concave base plate extending from the lowermost edge of said concave upright surface for supporting the chassis on a horizontal surface.

11. A sign according to claim 10, wherein the radius of curvature of the chassis and base plate is the same.

12. A sign according to claim 1, wherein a portion of said raised border of magnetic material extends across the bottom of said chassis.

13. A sign according to claim 12, wherein at least a portion of said cover sheet is exposed so that an edge of said cover sheet can be grasped and lifted by a user.

* * * * *